United States Patent [19]

Richeson et al.

[11] Patent Number: 4,852,528

[45] Date of Patent: Aug. 1, 1989

[54] PNEUMATIC ACTUATOR WITH PERMANENT MAGNET CONTROL VALVE LATCHING

[75] Inventors: William E. Richeson; Frederick L. Erickson, both of Fort Wayne, Ind.

[73] Assignee: Magnavox Government and Industrial Electronics Company, Fort Wayne, Ind.

[21] Appl. No.: 209,279

[22] Filed: Jun. 20, 1988

[51] Int. Cl.[4] ..... F01L 9/00; F01L 9/04

[52] U.S. Cl. ..... 123/90.11; 123/90.14; 137/625.64; 91/465

[58] Field of Search ..... 123/90.11, 90.14, 90.24; 137/625.64; 91/465

[56] References Cited

U.S. PATENT DOCUMENTS

| | | | |
|---|---|---|---|
| 2,552,960 | 5/1951 | Grieshaber et al. | 123/90.14 |
| 4,074,699 | 2/1978 | Stampfli | 137/625.64 |
| 4,257,573 | 3/1981 | Stampfli | 137/625.64 |
| 4,605,197 | 8/1986 | Casey et al. | 137/625.64 |

FOREIGN PATENT DOCUMENTS

| | | | |
|---|---|---|---|
| 197808 | 8/1978 | Fed. Rep. of Germany | 123/90.14 |

*Primary Examiner*—Charles J. Myhre

*Assistant Examiner*—Weilun Lo

*Attorney, Agent, or Firm*—Roger M. Rickert; Thomas A. Briody; Richard T. Seeger

[57] ABSTRACT

A bistable electronically controlled pneumatically powered transducer for use, for example, as a valve mechanism actuator in an internal combustion engine is disclosed. The transducer has an armature including a piston which is coupled to an engine valve, for example. The piston is powered by a pneumatic source and includes pneumatic damping with a one-way return of air compressed beyond source pressure back to the air source as it nears its destination position. Air supplied to power the piston may be differentially controlled to compensate for asymmetric resistance to movement and the air damping may be differentially controlled to provide dissimilar damping at the two extremes of piston motion. The armature is held in each of its extreme positions by pneumatic pressure under the control of control valves which are in turn held in their closed positions by permanent magnet latching arrangements and are released therefrom to supply air to the piston to be pneumatically driven to the other extreme position by an electromagnetic arrangement which temporarily neutralizes the permanent magnetic field of the latching arrangement.

15 Claims, 10 Drawing Sheets

PNEUMATIC ACTUATOR WITH PERMANENT MAGNET CONTROL VALVE LATCHING

SUMMARY OF THE INVENTION

The present invention relates generally to a two position, straight line motion actuator and more particularly to a fast acting actuator which utilizes pneumatic energy against a piston to perform fast transit times between the two positions. The invention utilizes a pair of control valves to gate high pressure air to the piston and latching magnets to hold the valves in their closed positions until a timed short term electrical energy pulse excites a coil around a magnet to partially neutralize the magnet's holding force and release the associated valve to move in response to high pressure air from a pressure source to an open position. Stored pneumatic gases accelerate the piston rapidly from one position to the other position. During movement of the piston from one position to the other, intermediate pressure air fills a chamber applying an opposing force on the piston to slow the piston. As the piston slows, pressure builds and when the pressure reaches the source pressure, a relief valve arrangement releases part of this trapped air back to the source.

This actuator finds particular utility in opening and closing the gas exchange, i.e., intake or exhaust, valves of an otherwise conventional internal combustion engine. Due to its fast acting trait, the valves may be moved between full open and full closed positions almost immediately rather than gradually as is characteristic of cam actuated valves.

The actuator mechanism may find numerous other applications such as in compressor valving and valving in other hydraulic or pneumatic devices, or as a fast acting control valve for fluidic actuators or mechanical actuators where fast controlled action is required such as moving items in a production line environment.

Internal combustion engine valves are almost universally of a poppet type which are spring loaded toward a valve-closed position and opened against that spring bias by a cam on a rotating cam shaft with the cam shaft being synchronized with the engine crankshaft to achieve opening and closing at fixed preferred times in the engine cycle. This fixed timing is a compromise between the timing best suited for high engine speed and the timing best suited to lower speeds or engine idling speed.

The prior art has recognized numerous advantages which might be achieved by replacing such cam actuated valve arrangements with other types of valve opening mechanism which could be controlled in their opening and closing as a function of engine speed as well as engine crankshaft angular position or other engine parameters.

In copending application Ser. No. 021,195 entitled ELECTROMAGNETIC VALVE ACTUATOR, filed Mar. 3, 1987 in the name of William E. Richeson and assigned to the assignee of the present application, there is disclosed a valve actuator which has permanent magnet latching at the open and closed positions. Electromagnetic repulsion may be employed to cause the valve to move from one position to the other. Several damping and energy recovery schemes are also included.

In copending application Ser. No. 07/153,257, entitled PNEUMATIC ELECTRONIC VALVE ACTUATOR, filed Feb. 8, 1988 in the names of William E. Richeson and Frederick L. Erickson and assigned to the assignee of the present application there is disclosed a somewhat similar valve actuating device which employs a release type mechanism rather than a repulsion scheme as in the previously identified copending application. The disclosed device in this application is a truly pneumatically powered valve with high pressure air supply and control valving to use the air for both damping and as the primary motive force. This copending application also discloses different operating modes including delayed intake valve closure and a six stroke cycle mode of operation.

In copending application Ser. No. 07/153,155 filed Feb. 8, 1988 in the names of William E. Richeson and Frederick L. Erickson, assigned to the assignee of the present application and entitled PNEUMATICALLY POWERED VALVE AOTUATOR there is disclosed a valve actuating device generally similar in overall operation to the present invention. One feature of this application is that control valves and latching plates have been separated from the primary working piston to provide both lower latching forces and reduced mass resulting in faster operating speeds. This high speed of operation results in a somewhat energy inefficient device.

The present application and copending application Ser. No. 07/209,272 filed in the names of William E. Richeson and Frederick L. Erickson, assigned to the assignee of the present invention and filed on even date herewith address, among other things, improvements in operating efficiency over the above noted devices.

Other related applications all assigned to the assignee of the present invention and filed in the name of William E. Richeson on Feb. 8, 1988 are Ser. No. 07/153,262 entitled POTENTIAL-MAGNETIC ENERGY DRIVEN VALVE MECHANISM where energy is stored from one valve motion to power the next, and Ser. No. 07/158,154 entitled REPULSION ACTUATED POTENTIAL ENERGY DRIVEN VALVE MECHANISM wherein a spring (or pneumatic equivalent) functions both as a damping device and as an energy storage device ready to supply part of the accelerating force to aid the next transition from one position to the other. The entire disclosures of all five of these copending applications are specifically incorporated herein by reference.

In the present invention, like Ser. No. 153,155, the power or working piston which moves the engine valve between open and closed positions is separated from the latching components and certain control valving structures so that the mass to be moved is materially reduced allowing very rapid operation. Latching and release forces are also reduced. Those valving components which have been separated from the main piston need not travel the full length of the piston stroke, leading to some improvement in efficiency.

Among the several objects of the present invention may be noted the provision of a bistable fluid powered actuating device characterized by fast transition times and improved efficiency; the provision of a pneumatically driven actuating device which is tolerant of variations in air pressure and other operating parameters; the provision of an electronically controlled pneumatically powered valve actuating device having improved damping features; the provision of a valve actuating device where a modest sacrifice in operating speed yields a significant increase in efficiency; and the provision of improvements in a pneumatically powered valve actuator where the control valves within the actuator cooperate with, but operate separately from the main working piston. These as well as other objects and advantageous features of the present invention will be in part apparent and in part pointed out hereinafter.

In general, a bistable electronically controlled fluid powered transducer has an armature including an air powered piston which is reciprocable along an axis between first and second positions along with a control valve reciprocable along the same axis between open and closed positions. A magnetic latching arrangement functions to hold the control valve in the closed position while an electromagnetic arrangement may be energized to temporarily neutralize the effect of the permanent magnet latching arrangement to release the control valve to move from the closed position to the open position. Energization of the electromagnetic arrangement causes movement of the valve in one direction along the axis first forming a sealed chamber including a portion of the armature and thereafter allowing fluid from a high pressure source to enter the closed chamber and drive the armature in the opposite direction from the first position to the second position along the axis. The distance between the first and second positions of the armature is typically greater than the distance between the open and closed positions of the valve.

Also in general and in one form of the invention, a pneumatically powered valve actuator includes a valve actuator housing with a piston reciprocable inside the housing along an axis. The piston has a pair of oppositely facing primary working surfaces. A pair of air control valves are reciprocable along the same axis relative to both the housing and the piston between open and closed positions. A coil is electrically energized to selectively opening one of the air control valves to supply pressurized air to one of the primary working surfaces causing the piston to move. Each of the air control valves includes an air pressure responsive surface which urges the control valve, when closed, against a spring bias toward its open position and there may be an air vent located about midway between the extreme positions of piston reciprocation for dumping expanded air from the one primary working surface and removing the accelerating force from the piston. The air vent also functions to introduce air at an intermediate pressure to be captured and compressed by the opposite primary working surface of the piston to slow piston motion as it nears one of the extreme positions. A one-way pressure relief valving arrangement such as a reed valve or check valve vents the captured air back to a high pressure air source. The air vent supplies intermediate pressure air to one primary working surface of the piston to temporarily hold the piston in one of its extreme positions pending the next opening of an air control valve. The air control valve is uniquely effective to vent air from the piston for a short time interval and at essentially source pressure back to the source and to finally dump air at a pressure not greater than source pressure after damping near the end of a piston stroke.

BRIEF DESCRIPTION OF THE DRAWING

Corresponding reference characters indicate corresponding parts throughout the several views of the drawing.

Figure 1:
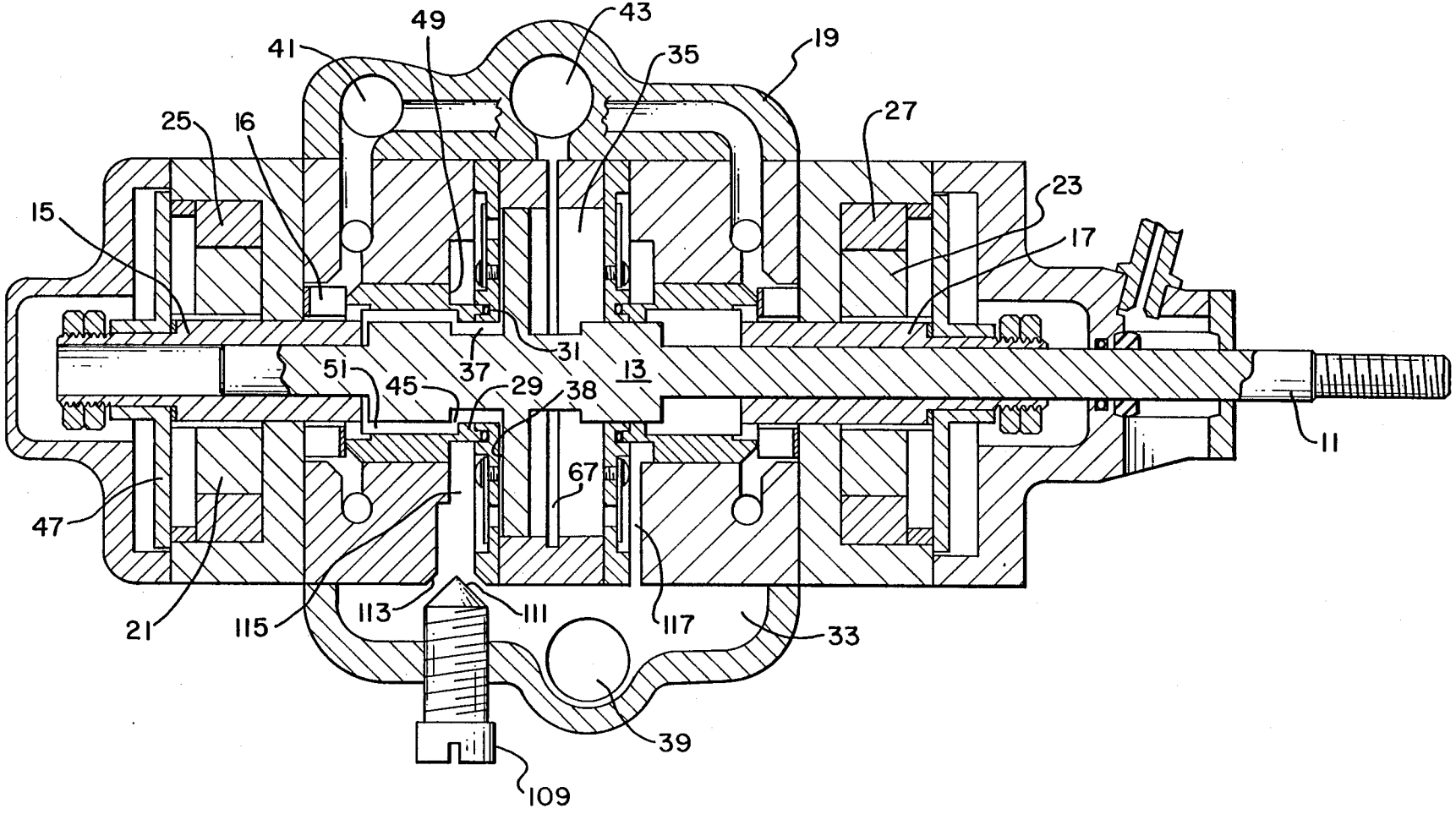
FIG. 1 is a view in cross-section showing the pneumatically powered actuator of the present invention with the power piston latched in its leftmost position as it would normally be when the corresponding engine valve is closed.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

The valve actuator is illustrated sequentially in FIGS. 1–9 to illustrate various component locations and functions in moving a poppet valve or other component (not shown) from a closed to an open position. Motion in the opposite direction will be clearly understood from the symmetry of the components. The actuator includes a shaft or stem 11 which may form a part of or connect to an internal combustion engine poppet valve. The actuator also includes a low mass reciprocable piston 13 and a pair of reciprocating or sliding control valve members 15 and 17 enclosed within a housing 19. The control valve members 15 and 17 are latched in one position by permanent magnets 21 and 23 and may be dislodged from their respective latched positions by energization of coils 25 and 27. The control valve members or shuttle valves 15 and 17 cooperate with both the piston 13 and the housing 19 to achieve the various porting functions during operation. The housing 19 has a high pressure inlet port 89, a low pressure outlet port 41 and an intermediate pressure port 43. The low pressure may be about atmospheric pressure While the intermediate pressure is about 10 psi. above atmospheric pressure and the high pressure is on the order of 100 psi. gauge pressure.

FIG. 1 shows an initial state with piston 13 in the extreme leftward position and with the air control valve 15 latched closed. In this state, the annular abutment end surface 29 is inserted into an annular slot in the housing 19 and seals against an o-ring 31. This seals the pressure in cavity 33 and prevents the application of any moving force to the main portion 13. In this position, the main piston 13 is being urged to the left (latched) by the pressure in cavity or chamber 85 which is greater than the pressure in chamber or cavity 37. In the position illustrated, annular opening 45 is in its final open position after having rapidly released compressed air from cavity 37 at the end of a previous leftward piston stroke.

When current flows in coil 25, the field of permanent magnet 21 is partially neutralized and source air pressure on face 49 forces the shuttle or control valve 15 leftwardly against the bias of wave washer 16.

Figure 2:
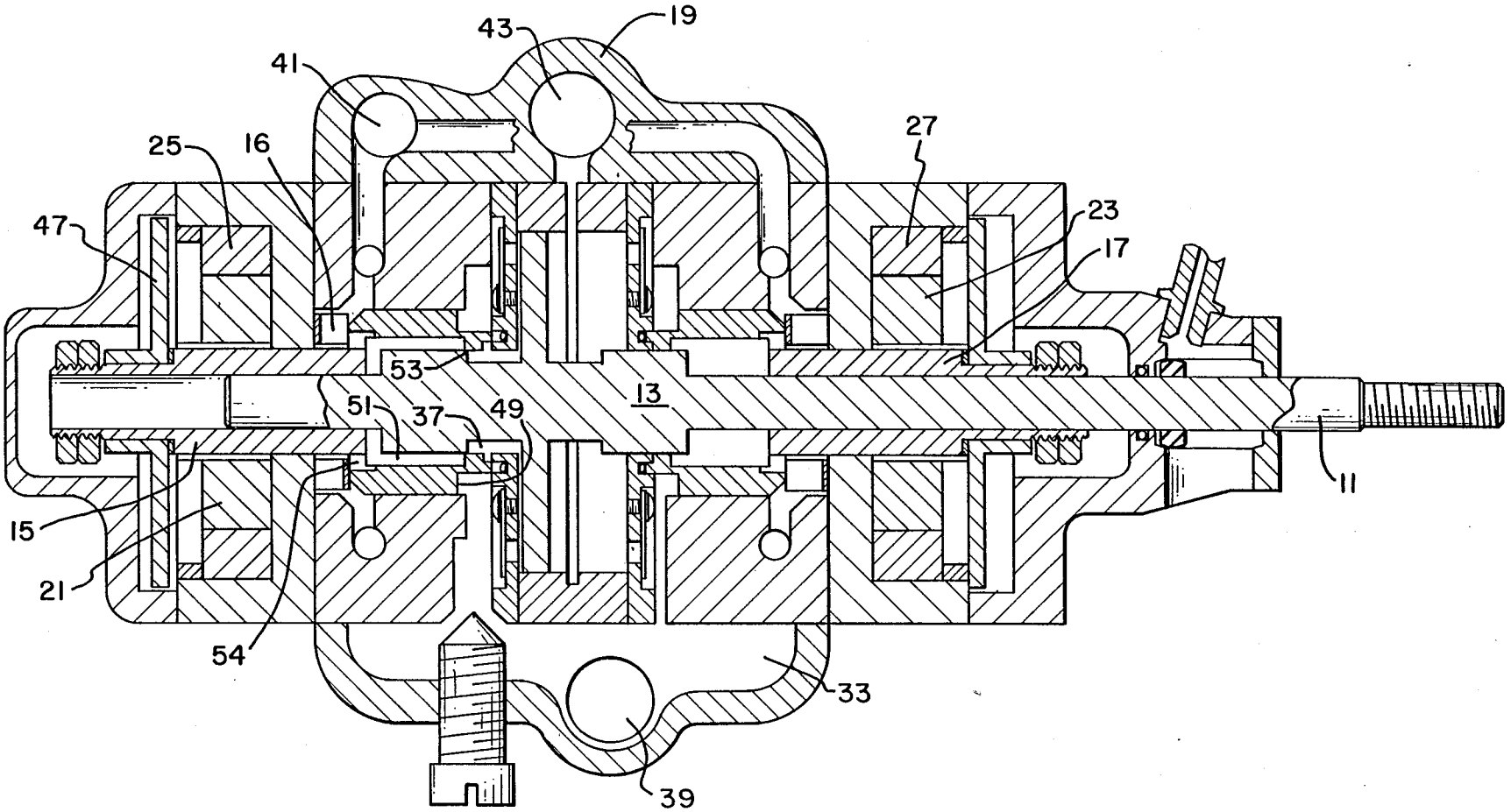
FIGS. 2–9 are views in cross-section similar to FIG. 1, but illustrating component motion and function as the piston progresses rightwardly to its extreme rightward or valve open position.

In FIG. 2, the shuttle valve 15 has moved toward the left, for example, 0.05 in. while piston 13 has not yet moved toward the right. The air valve 15 has opened because of an electrical pulse applied to coil 25 which has temporarily neutralized the holding force on iron armature or plate 47 by permanent magnet 21. When that holding force is temporarily neutralized. air pressure in cavity 33 which is applied to the air pressure responsive annular face 49 of valve 15 causes the valve to open. Notice that unlike the abovementioned Ser. No. 153,155 application, the communication between cavity 61 and the low pressure outlet port 41 has not been interrupted by movement of the valve 15. This communication is maintained at all times by way of a series of openings such as 54 in control valve 15 It should also be noted that, before the valve clears the slot containing o-ring 31, the edge of air valve 15 has overlapped the piston 13 at 53 closing annular opening 45 of FIG. 1 creating a closed chamber to assure rapid pressurization and maximum acceleration of the piston 13.

Figure 3:
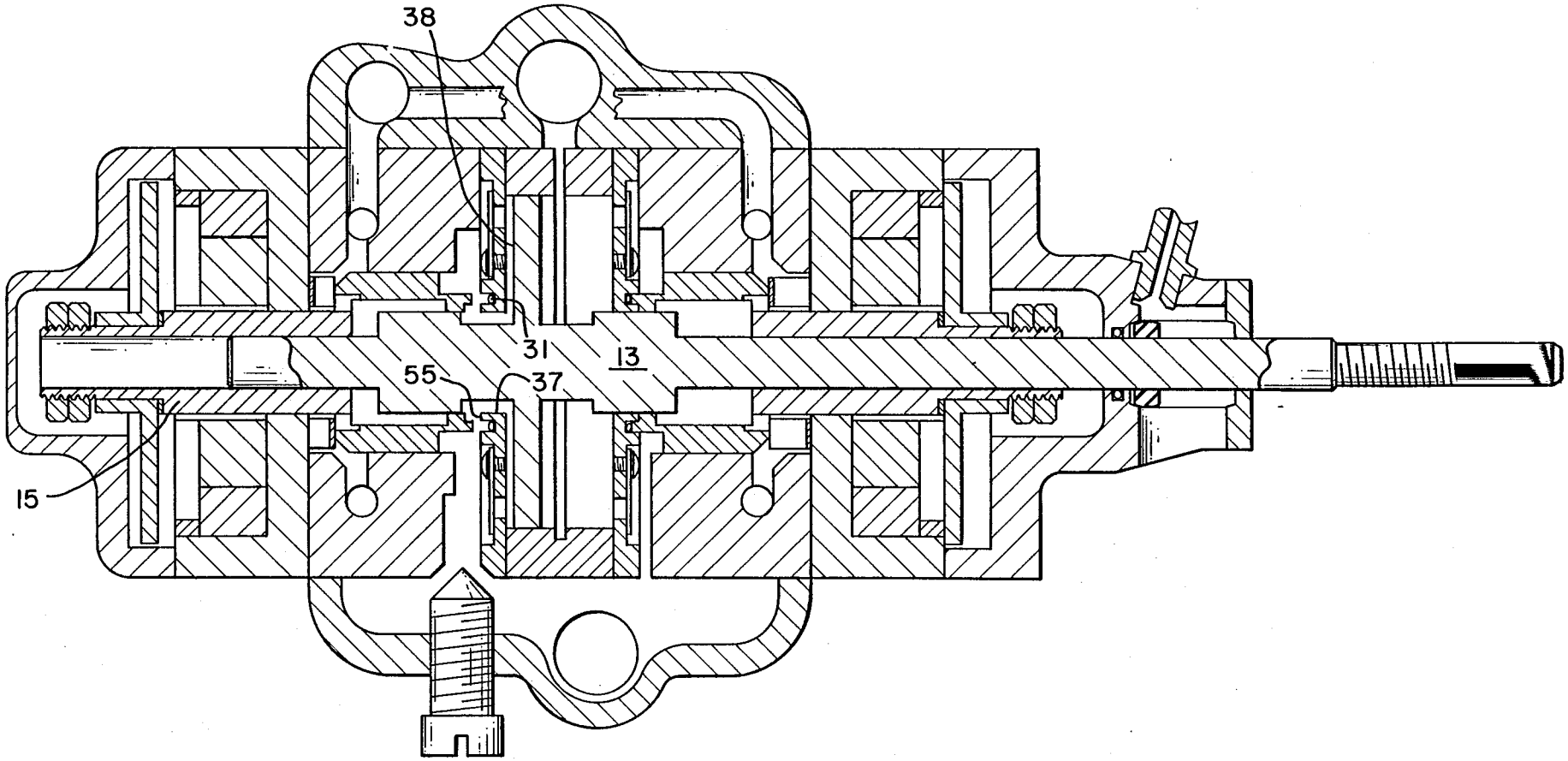

FIG. 3 shows the opening of the air valve 15 to about 0.10 in. ($\frac{2}{3}$ of its total travel) and movement of the piston 13 about 0.025 in. to the right.

In FIG. 3, the high pressure air had been supplied to the cavity 37 and to the face 38 of piston 13 driving that piston toward the right. That high pressure air supply by way of cavity 37 to piston face 88 is cut off in FIG. 4 by the edge of piston 13 passing the annular abutment 55 of the housing 19. Piston 13 continues to accelerate, however, due to the expansion energy of the high pressure air in cavity 37. The right edge of piston 13 is about to cut off communication at 57 between the port 43 and chamber 35. Disk 47 is nearing the leftward extreme of its travel and is compressing air in the gap 61. Air control valve 15 has also compressed the wave washer 16. This offers a damping or slowing effort to reduce the end approach velocity and consequently reduce any impact of the air valve components with the stationary structure. The compression of wave washer 16 also stores potential energy to power the return of the control valve 15 to the closed position. The annular surface 62 which is shown as a portion of a right circular cylinder may be undercut (concave) or tapered (a conical surface) to restrict air flow more near one or both extremes of the travel of plate 47 to enhance damping without restricting motion intermediate the ends if desired.

Figure 4:
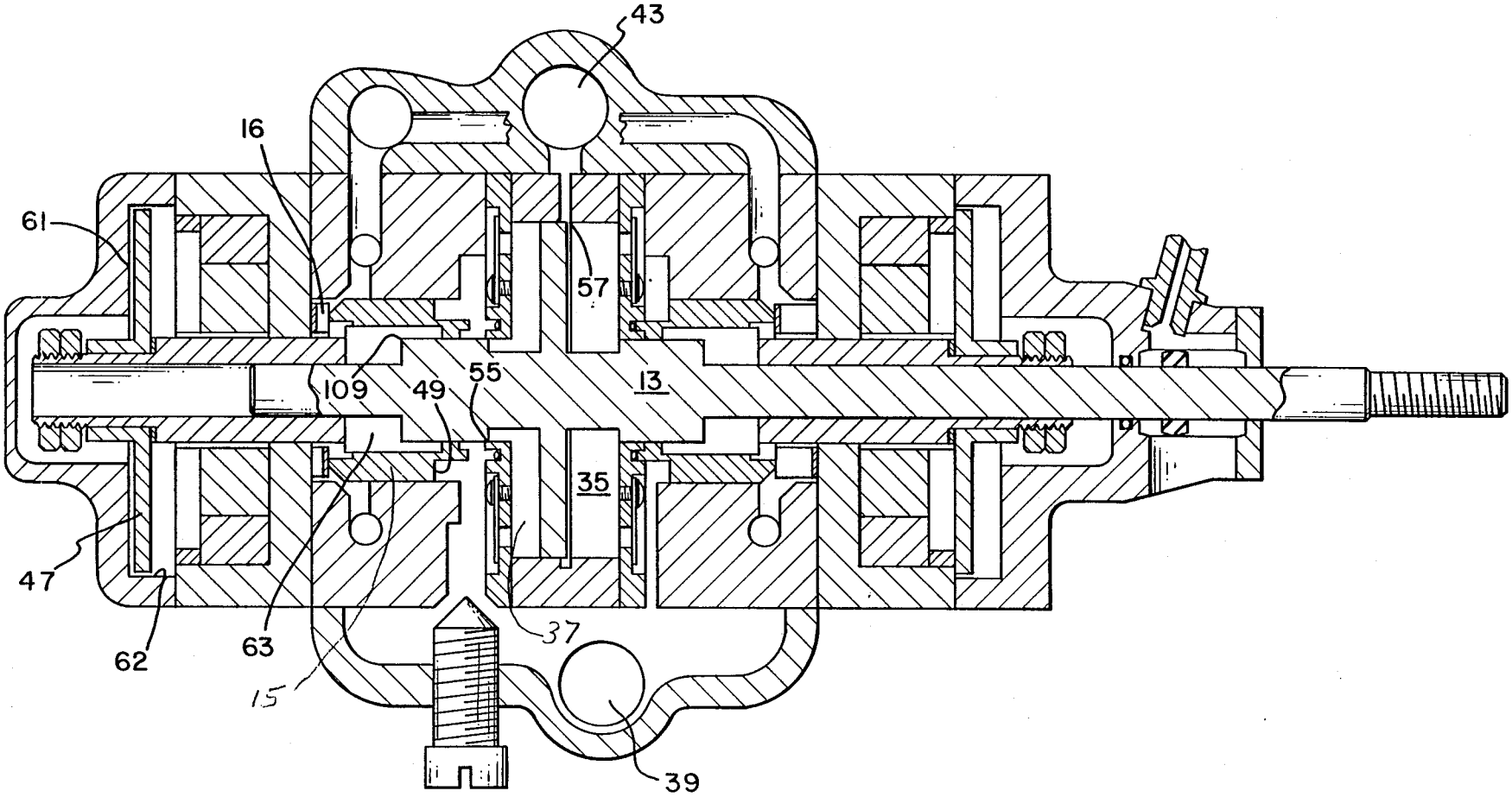
Figure 5:
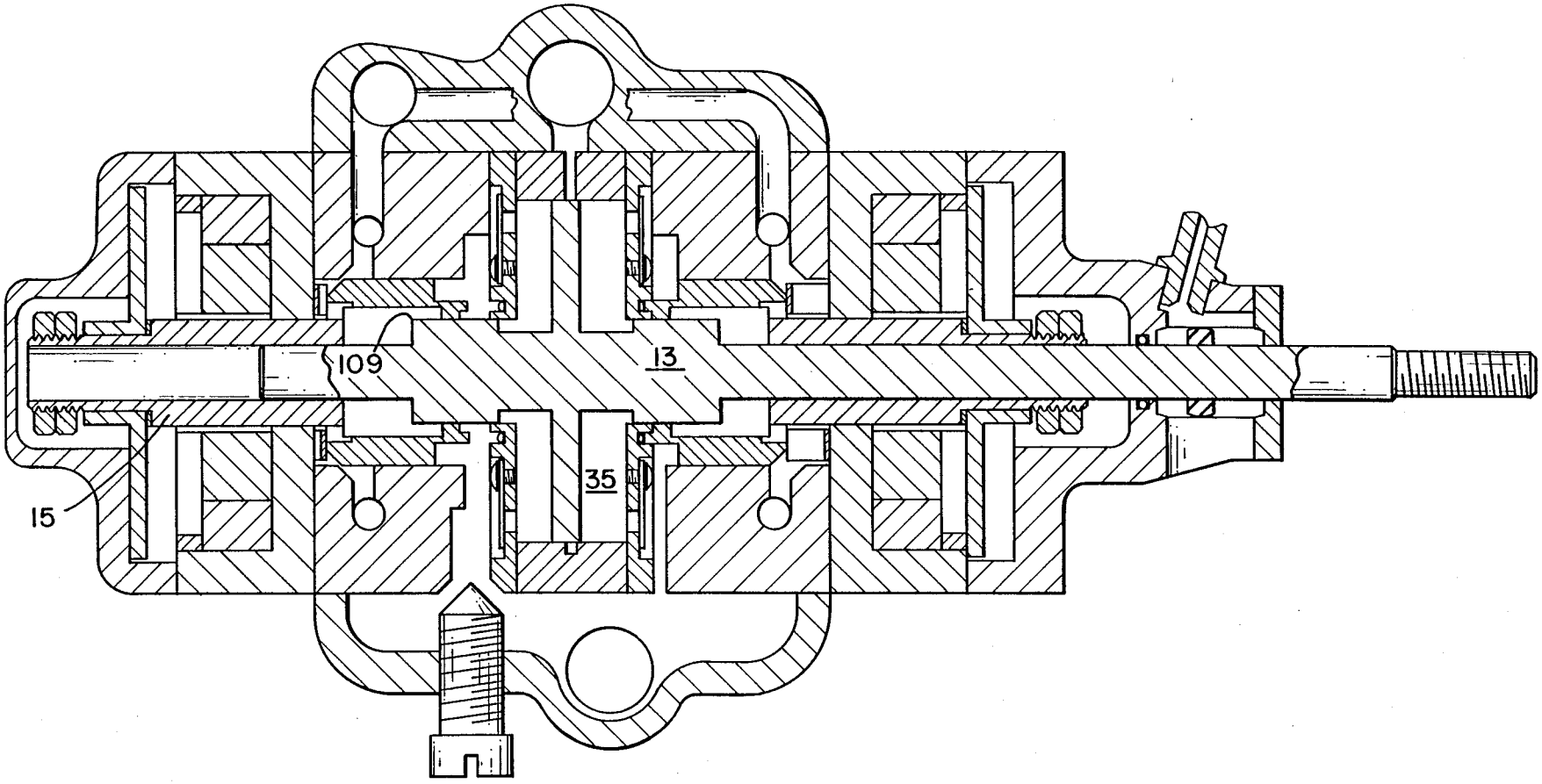

The piston 13 is continuing to accelerate toward the right in FIG. 4 and the air valve 15 has nearly reached its maximum leftward open displacement. The valve will tend to remain in this position for a short time due to the continuing air pressure on the annular surface 49 from high pressure source 39. There is a bleeding of air between the annular air valve and the piston into chamber 63 which is decreasing the pressure differential across the air valve 15 and this will soon allow the magnetic attraction of the disk 47 by the permanent magnet 21 along with the restorative force from wave washer 16 to pull the air valve 15 back toward its closed position. The wave washer or spring 16 functions as a spring bias means to provide damping of air control valve motion as the air control valve approaches an open position and provides a restorative force to aid rapid return of the air control valve to a closed position. This air bleeding is complete and the motion apparent in FIG. 6. In the transition from FIG. 4 to FIG. 5, the main piston 13 has just closed off communication between chamber 35 and medium pressure port 43 and further rightward motion of the main piston will compress the air trapped in chamber 35 so that the piston will be slowed and stopped by the time it has reached its extreme right hand position.

Figure 8:
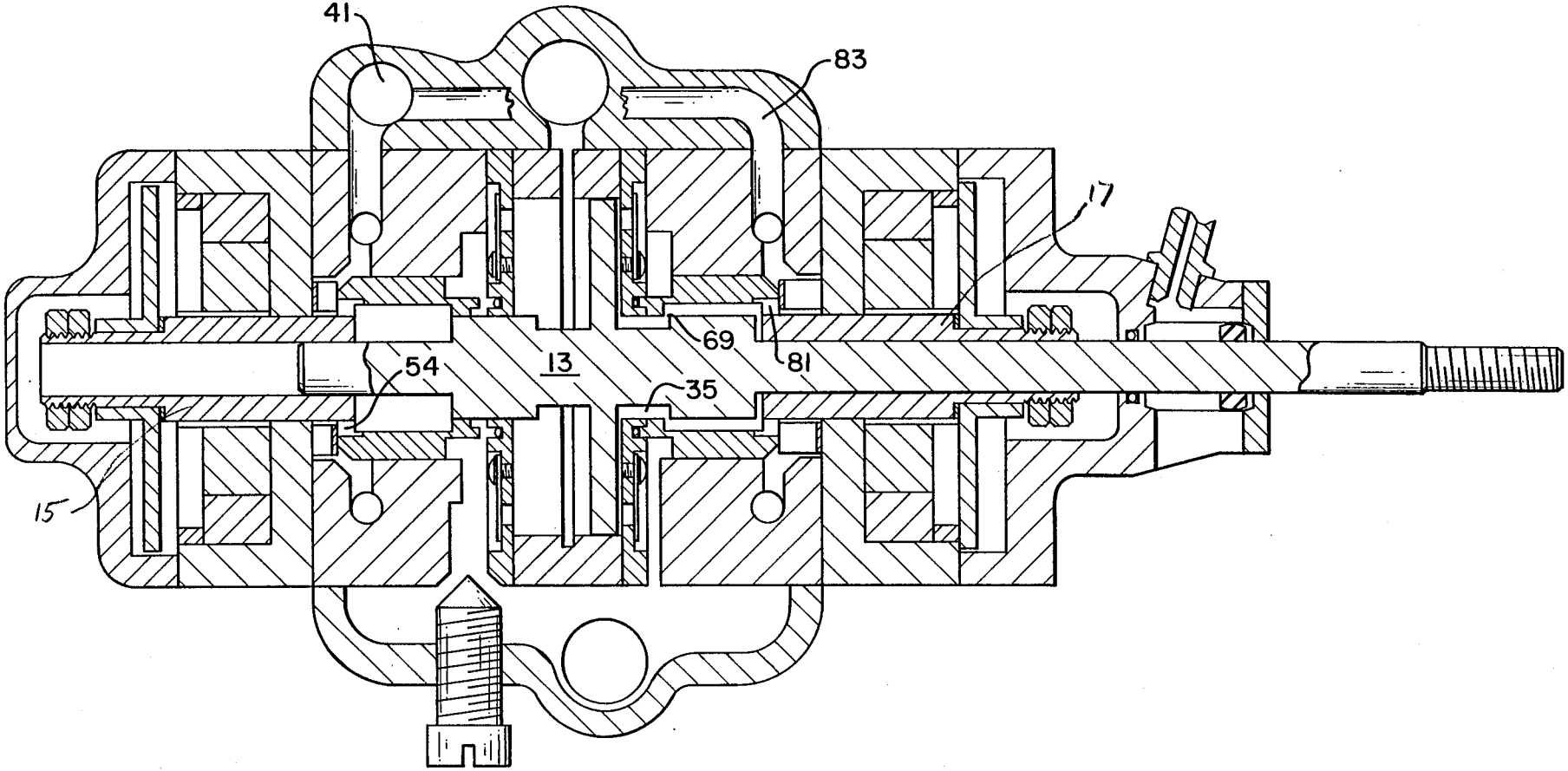

In FIG. 8, the air valve 15 is still in its extreme leftward position. The air valve is designed to close at about the same time as the main piston arrives at its furthest right hand location. Also, in FIG. 5, the piston is continuing to compress the air in cavity 35 slowing its motion.

Figure 6:
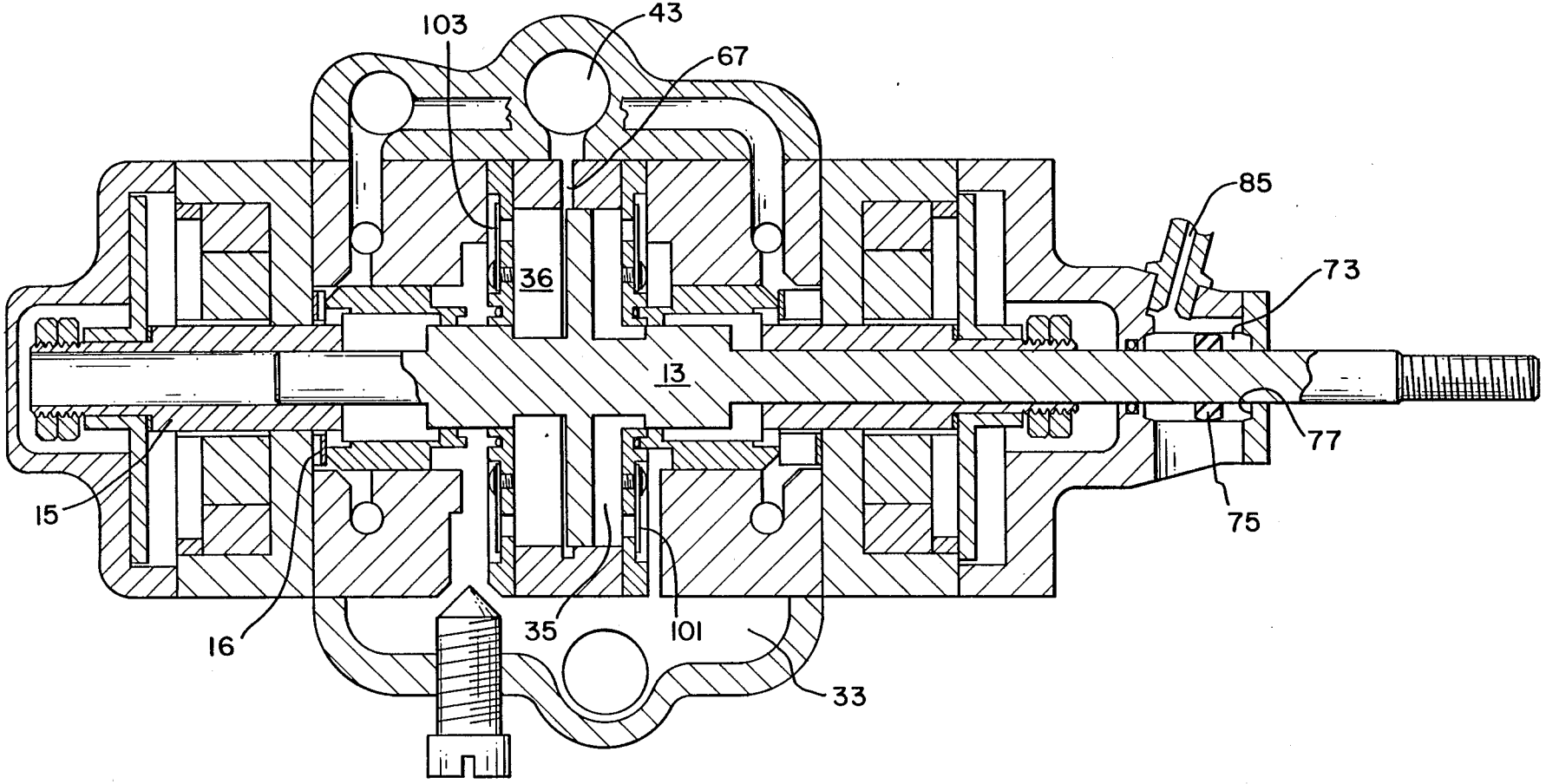
Figure 7:
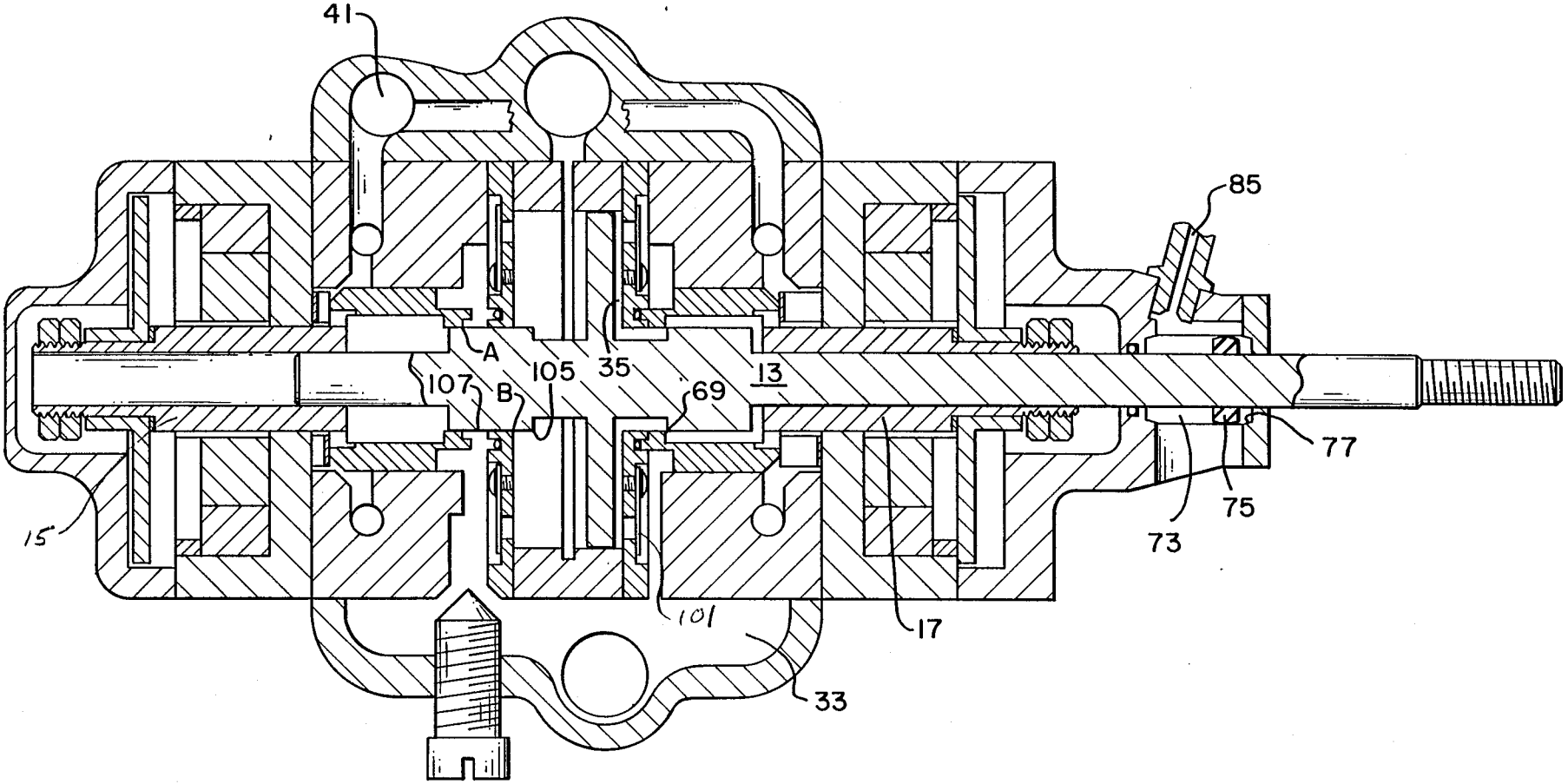

In FIG. 6, the air valve 15 is beginning to return to its closed position. The attractive force of the magnet 21 on the disk 47 and the force of wave washer 16 is causing the disk to move back toward the magnetic latch. Further rightward movement of the piston as depicted in FIG. 6, uncovers the partial annular slot 67 leading to intermediate pressure port 43 so that the high pressure air in chamber 36 has blown down to the intermediate pressure. In FIGS. 6 and 7, the continued piston motion and corresponding buildup of pressure in cavity 85 may cause the pressure in cavity 35 to exceed the source pressure in cavity 83. When this happens, reed valve 101 opens to vent this high pressure air back to the source by way of cavity 33. The reed valves 101 and 103 function to recapture part of the kinetic energy of the piston 13 when damping the piston motion by returning high pressure air to the source 33 rather than merely compressing air in the piston motion damping chamber 35 and then dumping that air to the atmosphere or to the intermediate pressure source.

In FIG. 7, the pressure in chamber 35 is at its maximum as set by the reed valve 101 and an annular opening is just beginning to form at 69 between the abutting corners of the piston 13 and air valve 17. This annular opening vents the high pressure air from chamber 85 just as the piston nears its right hand resting position to help prevent any rebound of the piston back toward the left.

It will be understood from the symmetry of the valve actuator that the behavior of the air control valves 15 and 17 in this venting or blow-down is, as are many of the other features such as the opening of reed valves 101 and 103, substantially the same near each of the opposite extremes of the piston travel. In each case, the air control valve, piston and a fixed portion of the housing cooperate to vent the damping air from the piston at the last possible moment and after any pressure exceeding that in chamber 33 has been recaptured while these same components cooperate at the beginning of a stroke to supply air to power the piston for a much longer portion of the stroke.

The damping of the piston motion near its right extremity is adjustable by controlling the intermediate pressure level at port 43 to effectively control the density of the air initially entrapped in chamber 35. If this intermediate pressure is too high, the piston will rebound due to the high pressure of the compressed air in chamber 35. If this pressure is too low, the piston will approach its end position too fast and may mechanically rebound due to metallic deflection or mechanical spring back. With the correct pressure, the piston will gently come to rest in its right hand position. A further final damping of piston motion may be provided during the last few thousandths of an inch of travel by a small hydraulic damper including a fluid medium filled cavity 73 and a small piston 75 fastened to and moving with the main piston 13. Near either end of the main piston travel, the small piston 75 enters a shallow annular restricted area 77 displacing the fluid therefrom and bringing the main piston to rest. Fluid, such as oil, may be supplied to the damping cavity 73 by way of inlet 85.

In FIG. 8, the air valve 15 is about midway along its return to its closed position. Final damping is almost complete as the pressure in chamber 35 is being relieved through the annular opening at 69 and through the opening 81 and channel 83 to the low pressure port 41 so that the pressure throughout chamber 85 is reduced to nearly atmospheric pressure. Note that valves 15 and 17 include a number of apertures such as 54 and 81 in their respective web portions allowing free air flow between chambers such as 35 and 83. In FIG. 8, the piston 13 is reaching a very low velocity, the damping is almost complete and the final damping by the small fluid piston 75 is underway.

Figure 9:
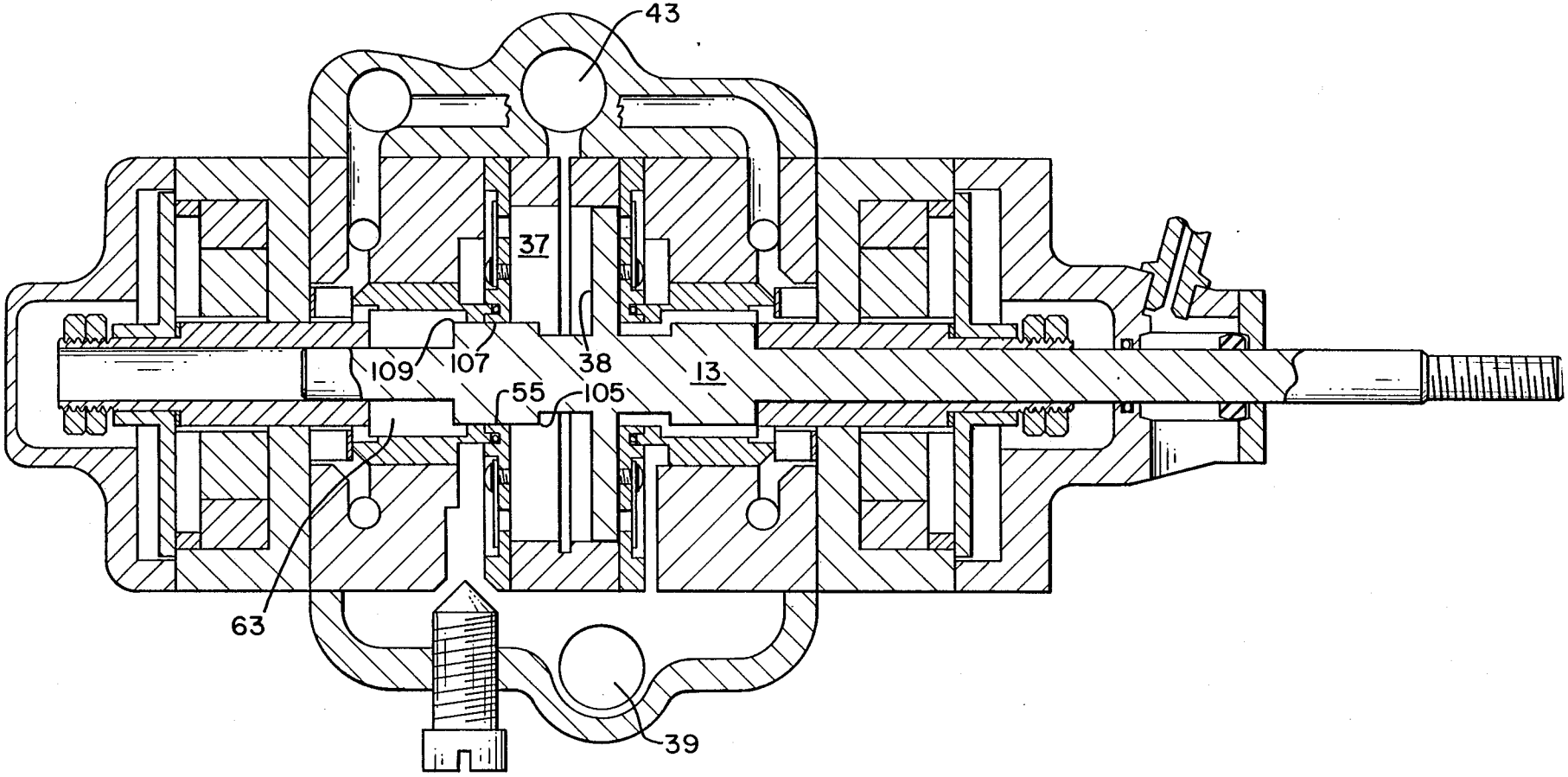

The main piston 13 has reached its righthand extreme in FIG. 9 and air valve 15 has closed. The supply of high pressure air from the source 39 to chamber 37 and the surface 88 of piston 13 has long since been interrupted by piston edge 105 passing housing edge 55 The piston 13 is held or latched in the position shown by the intermediate pressure in chamber 37 from source 48 acting on piston face 38.

In FIG. 1, which corresponds to a valve-closed condition, there is a slight gap between the piston face 88 and the valve housing while in FIG. 9 with the valve open, no such gap is seen. This gap provides for somewhat greater potential travel of the piston 13 than needed to close the engine valve insuring complete closure despite differential temperature expansions and similar problems which might otherwise result in the engine valve not completely closing. It should also be noted in following the sequence of FIGS. 1–9 that due to the length of the annular valving surface 107 of piston 13 between the edges 105 and 109. the chamber 63 is never in communication with the high pressure source chamber 33. Chamber 63 is maintained at the outlet pressure of port 41 at all times contrary to the similar chamber in the aforementioned Ser. No. 158,155.

In each of the drawing figures there is illustrated a differentially controllable valving arrangement for controlling the thrust on the piston 13 including adjustable set screw 109 having a conical end surface 111 variably spaced from a similarly shaped seat 113 for supplying air from the pressurized source to the air control valves to compensate for variations in external forces opposing piston motion. Set screw 109 may be adjusted to vary the restriction between chamber 33 and channel 115 leading to control valve 15. The corresponding channel 117 leading to control valve 17 has a fixed restriction. The restriction tends to be self adjusting in the sense that if piston motion is opposed then the pressure driving the piston increases tending to correct for the increased opposition.

Figure 10:
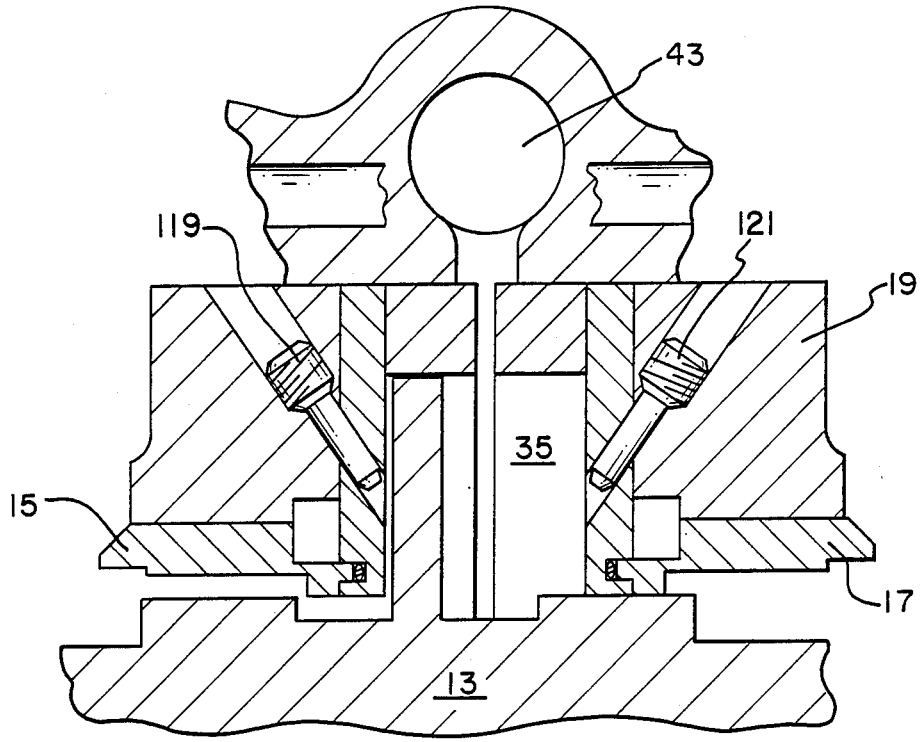
FIGS. 10 and 11 are views similar to FIG. 1, but illustrating certain modifications of the actuator.
Figure 11:
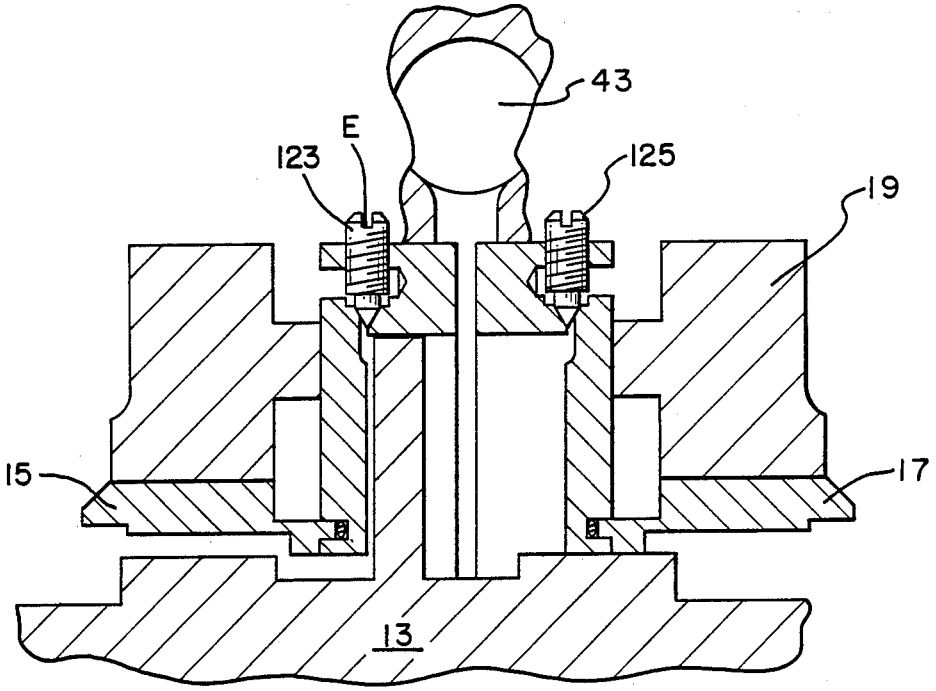

FIGS. 10 and 11 are similar to FIG. 1, but each illustrates a scheme wherein the pneumatic damping means is differentially adjustable to vary piston deceleration as the piston approaches one extremity relative to piston deceleration as the piston approaches the other extremity. The pneumatic damping means includes a volume varying adjustable member in FIG. 10, and, in FIG. 11, an adjustable member for controlling air escape from the pneumatic damping means.

In FIG. 10, a pair of adjustable set screws 119 and 121 seal corresponding holes leading to the chambers 36 and 35 respectively. Axial movement of one of these screws varies the volume of the piston motion damping chamber. When the piston is near the end of it a travel, this small volume becomes a significant part of the total volume of the damping chamber and a change in that volume has a significant effect on the chamber pressure and, therefore, on the damping force. For example, if set screw 121 is withdrawn increasing the volume of chamber 35, the opening of reed valve 101 (at peak or source pressure) will be delayed until the piston is closer to its rightmost position. A fine tuning of the damping motion at one extreme of piston travel relative to damping at the other extreme is therefore possible. Such a fine tuning may also be achieved by bleeding air from the damping chamber as in FIG. 11 rather than varying the volume of that chamber as in FIG. 10. In FIG. 11, a pair of needle valves 123 and 125 control air seepage from the damping chambers, thereby controlling the time at which peak pressure occurs.

Little has been said about the internal combustion engine environment in which this invention finds great utility. That environment may be much the same as disclosed in the abovementioned copending applications and the literature cited therein to which reference may be had for details of features such as electronic controls and air pressure sources. In this preferred environment, the mass of the actuating piston and its associated coupled engine valve is greatly reduced as compared to the prior devices. While the engine valve and piston move about 0.45 inches between fully open and fully closed positions, the control valves move only about 0.175 inches, therefor requiring less energy to operate. The air passageways in the present invention are generally large annular openings with little or no associated throttling losses.

From the foregoing, it is now apparent that a novel electronically controlled, pneumatically powered actuator has been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. A bistable electronically controlled fluid powered transducer having an armature reciprocable along an axis between first and second stable positions; a control valve reciprocable along said axis between open and closed positions; magnetic latching means providing a magnetic field for holding the control valve in the closed position; an electromagnetic arrangement for temporarily neutralizing the magnetic field of the permanent magnet latching arrangement to release the control valve to move from the closed position to the open position; and a source of high pressure fluid; energization of the electromagnetic arrangement causing movement of the control valve in one direction along the axis to first form a sealed chamber including a portion of the armature and thereafter applying high pressure fluid to the portion of the armature to drive the armature in the opposite direction from the first position to the second position along the axis.

2. A pneumatically powered valve actuator comprising a valve actuator housing; a piston reciprocable within the housing along an axis, the piston having a pair of oppositely facing primary working surfaces; a pressurized air source; a pair of air control valves reciprocable along said axis relative to both the housing and the piston between open and closed positions; means for selectively opening one of said air control valves to supply pressurized air from the air source to one of said primary working surfaces causing the piston to move; and pneumatic means for decelerating the piston near the extremities of its reciprocation including a one-way pressure relief valving arrangement for venting air from the pneumatic means to the pressurized air source.

3. The pneumatically powered valve actuator of claim 2 further comprising a differentially controllable valving arrangement for supplying air from the pressurized source to the air control valves to compensate for variations in external forces opposing piston motion.

4. The pneumatically powered valve actuator of claim 2 wherein the pneumatic means is differentially adjustable to vary piston deceleration as the piston approaches one extremity relative to piston deceleration as the piston approaches the other extremity.

5. The pneumatically powered valve actuator of claim 4 wherein the pneumatic means includes a volume varying adjustable member.

6. The pneumatically powered valve actuator of claim 4 wherein the pneumatic means includes an adjustable member for controlling air escape from the pneumatic means.

7. The pneumatically powered valve actuator of claim 2 further comprising spring bias means for each air control valve to continuously urge the respective air valve toward a closed position.

8. The pneumatically powered valve actuator of claim 7 wherein the spring bias means provides damping of air control valve motion as the air control valve approaches an open position and a restorative force to aid rapid return of the air control valve to a closed position.

9. The pneumatically powered valve actuator of claim 2 wherein air control valve motion creates a sealed chamber including the primary working surface before the air valve opens to supply high pressure air to the piston.

10. The pneumatically powered valve actuator of claim 2 wherein the one-way pressure relief valving arrangement comprises a plurality of reed valves.

11. A pneumatically powered valve actuator comprising a valve actuator housing: a piston reciprocable within the housing along an axis, the piston having a pair of oppositely facing primary working surfaces; a pressurized air source; a pair of air control valves reciprocable along said axis relative to both the housing and the piston between open and closed positions; means for selectively opening one of said air control valves to supply pressurized air from the air source to one of said primary working surfaces causing the piston to move; pneumatic means for decelerating the piston near the extremities of its reciprocation; and spring bias means for each air control valve to continuously urge the respective air valve toward a closed position.

12. A pneumatically powered valve actuator comprising a valve actuator housing; a piston reciprocable within the housing along an axis, the piston having a pair of oppositely facing primary working surfaces; a pressurized air source; a pair of air control valves reciprocable along said axis relative to both the housing and the piston between open and closed positions; means for selectively opening one of said air control valves to supply pressurized air from the air source to one of said primary working surfaces causing the piston to move; pneumatic means for decelerating the piston near the extremities of its reciprocation; and differentially controllable valving means for supplying air from the pressurized source to the air control valves to compensate for variations in external forces opposing piston motion.

13. A bistable electronically controlled pneumatically powered transducer having an armature including a piston reciprocable between first and second positions, motive means comprising a source of compressed air, an air vent located about midway between the first and second positions for dumping air and removing the accelerating force from the piston and for introducing air at an intermediate pressure to be captured and compressed by the piston to slow armature motion as the armature nears one of said positions, and means for returning air which is compressed to a pressure greater than the source pressure to the source.

14. The bistable electronically controlled pneumatically powered transducer of claim 13 further comprising a pair of air control valves and a pair of spring biasing devices for holding the air control valves in closed positions.

15. The bistable electronically controlled pneumatically powered transducer of claim 13 wherein the means for returning comprises a plurality of reed valves.

* * * * *